US005427476A

United States Patent [19]

Pienaar et al.

[11] Patent Number: 5,427,476

[45] Date of Patent: Jun. 27, 1995

[54] MINE PROP HEADBOARD

[75] Inventors: Frans R. P. Pienaar, Krugersdorp; Peter J. Cook, Johannesburg, both of South Africa

[73] Assignee: HL & H Timber Products (PTY) Ltd., Johannesburg, South Africa

[21] Appl. No.: 25,552

[22] Filed: Mar. 3, 1993

[30] Foreign Application Priority Data

Mar. 4, 1992 [ZA] South Africa ..... 92/1611

[51] Int. Cl.[6] ..... E21D 15/00; E21D 15/30

[52] U.S. Cl. ..... 405/288; 248/357; 405/289

[58] Field of Search ..... 405/288, 289, 290; 248/354.3, 354.1, 354.6

[56] References Cited

U.S. PATENT DOCUMENTS

| | | | |
|---|---|---|---|
| 1,528,034 | 3/1925 | Thielmann . | |
| 1,946,720 | 2/1934 | Stearns . | |
| 2,190,556 | 2/1940 | Wiebecke et al. . | |
| 3,703,269 | 11/1972 | Meriz | 248/254 L |
| 4,004,771 | 1/1977 | Plevak et al. | 248/357 |
| 4,120,164 | 10/1978 | Tomlin | 405/289 |
| 4,465,405 | 8/1984 | Dürrfeld | 405/289 |
| 4,773,792 | 9/1988 | Landers | 405/230 |
| 5,149,228 | 9/1992 | Pienaar et al. | 405/289 |
| 5,186,430 | 2/1993 | Ellithorpe | 248/354.3 |

FOREIGN PATENT DOCUMENTS

| | | |
|---|---|---|
| 1027157 | 4/1958 | Germany . |
| 1027158 | 4/1958 | Germany . |
| 1177588 | 9/1964 | Germany . |
| 396454 | 8/1933 | United Kingdom . |
| 912947 | 3/1982 | U.S.S.R. . |

OTHER PUBLICATIONS

Brochure re Propsetter TM assembly distributed by HL&M Mining Timber, bearing a copyright date of 1992.

*Primary Examiner*—Dennis L. Taylor
*Attorney, Agent, or Firm*—Morgan & Finnegan

[57] ABSTRACT

The mine prop headboard (10) is used to support an inflatable grout bag (44) and is located transversely on an end of an elongate mine prop (12) which is in use installed upright between a hanging wall and a footwall in a mine working. The headboard includes a chock assembly which is composed of parallel, elongate timber chocks (14). A steel reinforcement sheet is secured to and extends over the support surface of the chock assembly to provide tensile reinforcement a grout bag is placed on the headboard and is inflated with grout under pressure sufficient to apply a compressive axial force to the prop between the hanging wall and the footwall.

15 Claims, 2 Drawing Sheets

MINE PROP HEADBOARD

BACKGROUND TO THE INVENTION

This invention relates to a mine prop headboard that can be used to support a preload bag.

Elongate mine props, typically timber-based, are widely used to provide yielding support to the hanging wall in mine stopes. Conventional practice is to trim the prop to length in the stope and then to tilt it to an upright orientation between the footwall and the hanging wall. Timber wedges are then hammered into position between the hanging wall and the top of the prop. The wedges have a dual purpose. Firstly, they serve to wedge the prop in position to prevent it from falling over during blasting. Secondly, they are employed to apply a degree of axial preload to the prop.

It is highly desirable to apply a fairly large axial preload force to the prop at installation, since this will immediately render the prop suitable to take the working load of the hanging wall as the hanging wall closes towards the footwall. However preload force applied by wedges as described above is very much less than that which is desirable.

It has therefore been proposed to provide the prop with a headboard on which an inflatable bag can be supported. During installation, the bag is positioned in a deflated condition on the headboard, between the head of the prop and the hanging wall. The bag is then inflated to a substantial pressure with a settable grout with the result that a substantial preload force, possibly in the range 10t to 20t, is applied axially to the prop.

SUMMARY OF THE INVENTION

A first aspect of the invention provides a mine prop headboard which is dimensioned to support an inflatable grout bag and which is adapted for location transversely on an end of an elongate mine prop which is in use installed upright between a hanging wall and a footwall in a mine working, the headboard comprising:

a chock assembly which includes parallel, elongate timber chocks and which defines an upper support surface, and reinforcement means secured to and extending over the support surface of the chock assembly to provide tensile reinforcement for the chock assembly when a grout bag is in use positioned on the headboard and is inflated with grout under pressure thereby to apply a compressive axial force to the prop between the hanging wall and the footwall.

In the preferred embodiment, the reinforcement means comprises a sheet steel member fastened intimately to and extending over the support surface of the chock assembly. Conveniently, opposite ends of the sheet steel member are bent over to form bag-locating flaps which in use are locatable over opposite extremities of the grout bag thereby to locate the bag relative to the chock assembly.

Conveniently also, the sheet steel member is nailed to the chocks. Typically, the chocks are spaced apart by at least one endgrain timber block in which the timber grain is operatively vertical.

There may be a pair of chocks spaced apart by at least one block, the chocks and the at least one block, in combination, forming an H-shape in plan view.

Advantageously, a centralising formation which operates in use to centralise the combination of the chocks and the at least one block on the end of the elongate prop. The centralising formation may comprise a hole in the underside of the headboard, the hole being adapted to receive a peg protruding from the end of the prop.

The headboard may also include a sheet steel anchoring member which extends across the at least one block and is secured to the chocks on opposite sides of the at least one block. The sheet steel anchoring member may have generally a top-hat or channel cross-section.

In addition, the headboard may include an opening which is located in a position to grant access to a filler nozzle for the grout bag.

Another aspect of the invention provides the combination of a mine prop headboard as summarised above and an elongate mine prop, the headboard spanning transversely across the upper end of the mine prop, preferably with the upper end of the mine prop bearing partially against the at least one block and partially against the chocks. The combination may furthermore include an inflatable grout bag located on and supported by the headboard.

BRIEF DESCRIPTION OF THE DRAWINGS

The invention will now be described in more detail, by way of example only, with reference to the accompanying drawings in which.

DESCRIPTION OF EMBODIMENTS

Figure 1:
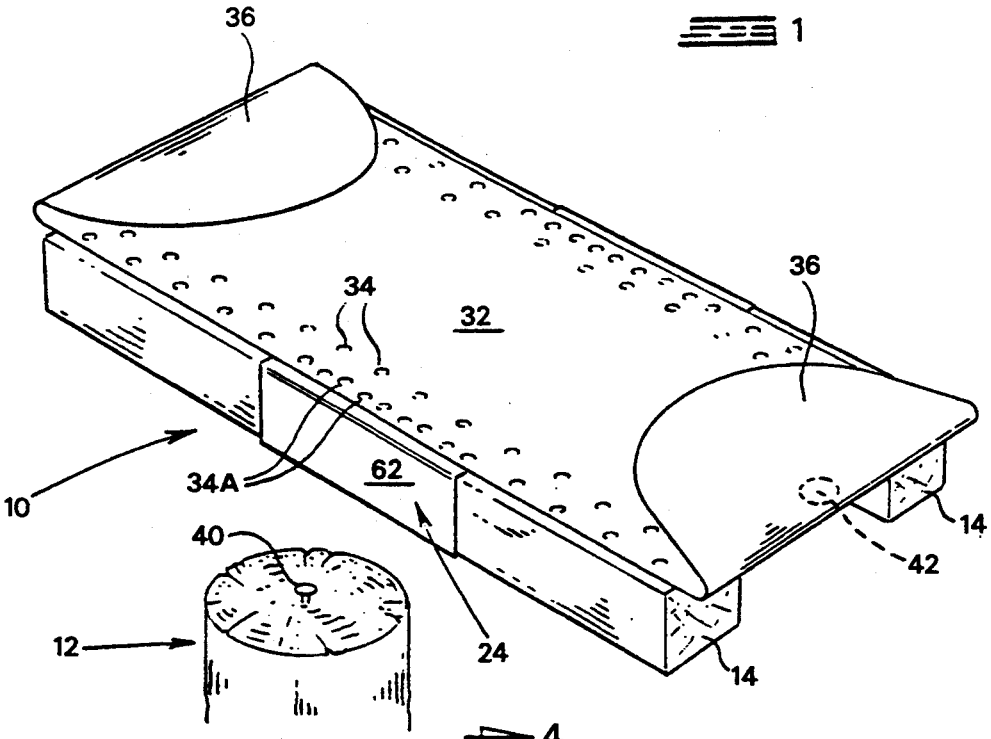
FIG. 1 shows a perspective view of a mine prop headboard of the invention.

FIG. 1 shows a mine prop grout bag supporting headboard 10 which in use is located transversely across the top of a conventional elongate, timber-based mine prop 12. The prop 12 could, for instance, be a conventional PIPESTICK or other prop.

The headboard 10 has four timber components, namely two elongate, rectangular section timber chocks 14 and two side-by-side rectangular timber blocks 18 which space the chocks apart from one another. The assembly of chocks and blocks form an H-shape in plan or underplan view. In the chocks 14, the timber grain runs in the longitudinal direction, while in the blocks 18, the timber grain is operatively vertical, i.e. into the plane of the paper in FIGS. 2 and 3.

Figure 5:
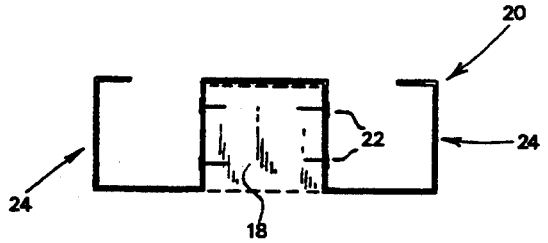
FIG. 5 illustrates the cross-section of the sheet steel anchoring member.

The headboard 10 includes a sheet steel anchoring member 20 which is of a generally top-hat cross-sectional shape. The sheet steel typically has a gauge of 0,8 mm. As illustrated in FIG. 5, the blocks 18, only one of which is visible, nest within the anchoring member and are secured to the anchoring member by means of nails 22 driven laterally through the sheet steel and into the timber of the blocks.

Figure 4:
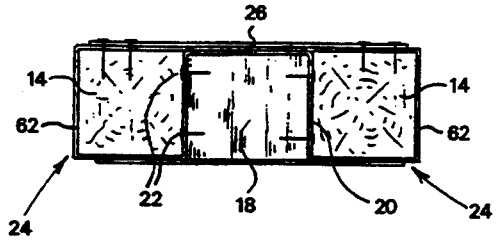
FIG. 4 shows a cross-section at the line 4—4 in FIG. 2.

The anchoring member 20 is then located between the two chocks 14 with the side portions 24 of the member passing about the chocks as illustrated in FIG. 4.

Figure 3:
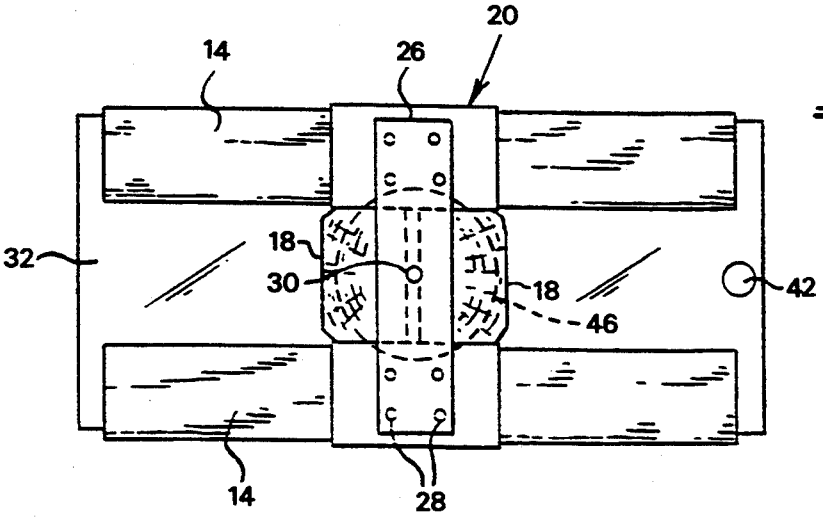
FIG. 3 shows an underplan view of the headboard.

Referring to FIG. 3, a sheet steel strap 26 passes over the blocks and overlies the chocks 14. Nails 28 are driven through the overlying portions of the strap, through the relevant portions of the anchoring member 20 and into the chocks.

A central locating hole 30 is formed in the underside of the headboard as seen in FIG. 3.

Figure 2:
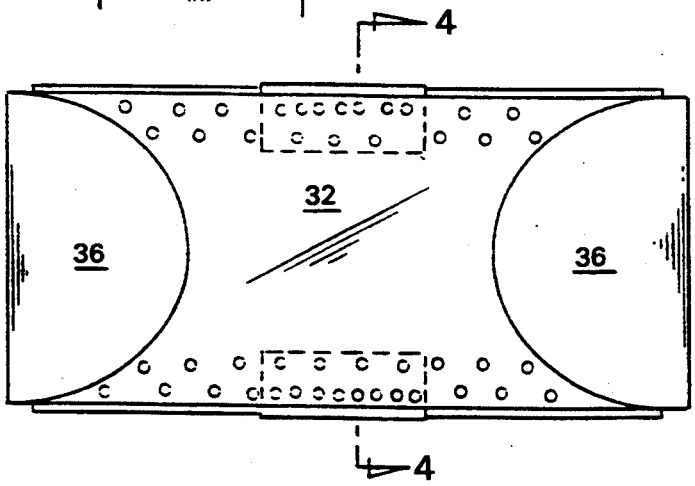
FIG. 2 shows a plan view of the headboard.

Referring to FIGS. 1 and 2, a sheet steel reinforcing member 32, typically of 0,8 mm gauge, is laid out over the upper surface of the assembly of chocks and blocks and is intimately secured to that assembly by an array of nails 34. Those nails 34A at the edges of the sheet steel member 32 also pass through the extremities of the anchoring member 20.

While the width of the sheet steel member 32 corresponds closely with that of the assembly of chocks and blocks, its length is somewhat greater than that of the assembly. End regions of the sheet steel member 32 are folded over as illustrated to form two flexible flaps 36.

The combination of anchoring member 20, strap 26 and reinforcing member 32, and the array of securing nails, ensures that the headboard 10 has a robust, integral structure which can be manhandled under normal conditions without breaking up. In practice, the chocks 14 will typically have a dimensions of 100 mm×100 mm×750 mm, and the blocks 18 dimensions of 120 mm×120 mm×100 mm. With these dimensions the headboard 10 has a mass of around 15 kg and so can be manhandled with comparative ease by a single mine worker. Although not illustrated in the drawings, a handle can be provided on the headboard to facilitate carrying.

In use, the prop 12 is first trimmed to approximate length, taking the thickness of the headboard into account, to suit the spacing between the hanging wall and the footwall in a mine working. Next, a nail 40 or other peg (FIG. 1) is hammered centrally into the upper end of the prop 12 so that a portion of the nail protrudes. With the prop lifted just above horizontal on the mine footwall, the nail is located in the hole 30. A rectangular inflatable grout bag 44 of known type, seen in FIG. 8, in this case one manufactured by Tufbag (Pty) Limited, is then placed on the upper surface of the headboard, i.e. on the sheet steel member 32, with its ends underneath the flaps 36 and with its filler nozzle aligned with an opening 42 formed in the member 32.

The prop 12 and headboard 10 are then canted upright to bring the prop to a substantially vertical position with the upper surface of the headboard 10 lying in a substantially horizontal plane and with the upper surface of the deflated bag 44 just beneath the hanging wall. Settable grout, typically a grout of the kind supplied for the purpose by Fosroc (Pty) Limited is then pumped into the bag 44. The pump that is used is typically of the kind made for the purpose by Nicro (Pty) Limited. The bag expands as it is inflated and comes into contact with the hanging wall. The bag is typically inflated to a pressure of about 4 bar, generating an axial compressive load of around 10t on the prop 12. The pump is then disconnected and a non-return valve in the nozzle of the bag ensures that the applied pressure in the bag is maintained.

Figure 8:
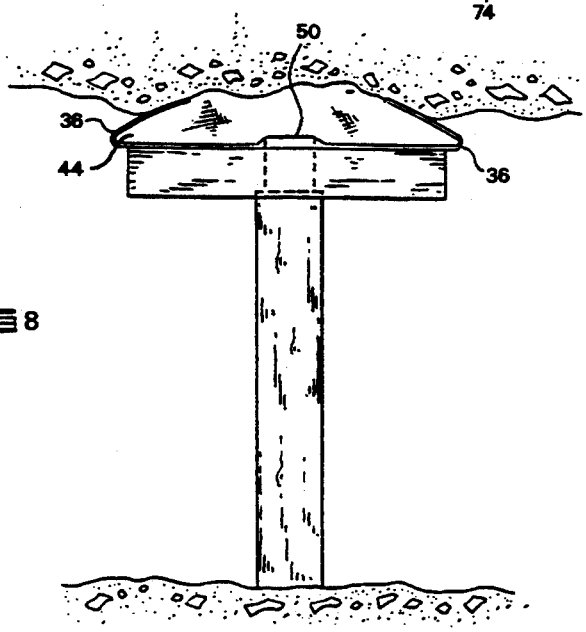
FIG. 8 illustrates the headboard of the invention in use.

The installed position of the prop, headboard and bag is illustrated in FIG. 8.

It will be appreciated that the function of the nail 40 and hole 30 is to centralise the headboard, on installation, on the upper end of the prop 12. Referring to FIG. 3, the line 46 indicates the perimeter of the prop 12 and it will be noted that the diameter of the prop is slightly greater than the relevant lateral dimension of the blocks 18. In general, the diameter of the prop 12 should not be too great in relation to the lateral dimension of the blocks 18 so that there is not too great an overlap between the chocks 14 and the prop. Too great an overlap could in practice in lead to crushing and early failure of the chocks 14.

The preload applied to the prop 12 on installation renders the prop immediately capable of performing a propping function. In other words, there is no need to wait for the hanging wall to close on the footwall before the prop starts taking any meaningful load. As closure of the stope takes place with passage of time, the prop yields axially, by shortening in length, but still continues to support the applied load.

It will be appreciated that the upper part of the headboard is subjected to substantial tensile bending forces under the axially applied load. The lower part is subjected to correspondingly high compressive bending forces. Excessive bending forces could lead to destruction of the headboard. The tensile forces are however resisted efficiently by the sheet steel member 32 which, being intimately connected to the chocks 14, creates what is in effect a composite steel and timber headboard structure.

The compressive forces in the lower part of the headboard are likewise resisted to some extent by the anchoring member 20, and the strap 26 binds the chocks to one another and resists any tendency for the chocks to move apart under the applied compressive loading.

The endgrain, nature of the blocks 18, i.e. the orientation in the direction of load application, also serves an important function under loading. It will be appreciated that the blocks are stronger in compression than the chocks because of their grain orientation. Under applied loading during initial testwork, it has been observed that the blocks are in fact displaced upwardly relative to the chocks and actually begin to deform the sheet steel member 32 in the central region. This deformation is indicated by the numeral 50 in FIG. 7.

The end result is that the blocks perform a "punching" action on the inflated grout bag and tend to displace grout material in the bag to the sides. It is anticipated that after the load has been applied for some time, the hanging wall will eventually come into virtually direct contact with the blocks 18, via the bag and member 32, so that the prop 12 takes direct loading from the hanging wall.

The flaps 36 also serve an important function. With the ends of the grout bag located beneath these flaps, the bag is unable to move sideways, in the relevant direction, relative to the headboard, and therefore maintains its central position relative to the headboard and prop.

As an alternative to the use of a nail or peg in the end of the prop and a corresponding hole in the headboard, various other centralising techniques may be used. The underside of the headboard could, for instance, have a ring or other formation mounted thereon into which the end of the prop would fit during installation. This would avoid the necessity for a worker to hammer a nail into the end of the prop after the prop has been trimmed to length.

Figure 6:
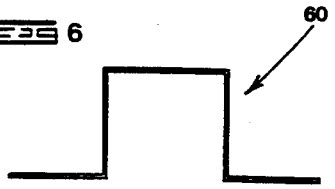
FIG. 6 illustrates the cross-section of an alternative sheet steel anchoring member.

FIG. 6 shows an alternative cross-sectional shape for the anchoring member. In this case, the anchoring member 60 is of true top-hat configuration, without the side portions 62 of the member 20 that locate against the sides of the chocks. It is believed that the anchoring member 20 is however preferable because the side portions 62 will assist the headboard in resisting bending loads.

Figure 7:
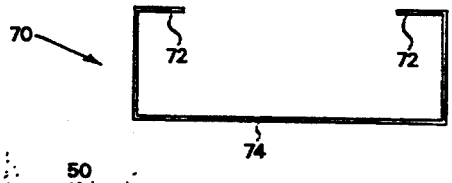
FIG. 7 illustrates the cross-section of another sheet steel anchoring member.

FIG. 7 illustrates another cross-sectional shape for the anchoring member. In this case, the anchoring member 70 is merely in the form of a channel with re-entrant lips 72 as illustrated. The base 74 of the channel spans beneath the blocks 18 and secural is achieved by means of vertically applied nails which are driven through the lips 72 into the chocks 14. There is no direct attachment to the blocks 18. With this type of anchoring member, the plate 26 used with the anchoring members described previously can be omitted.

An important advantage of the illustrated headboard is the fact that it can be manufactured at modest cost, since the major components are timber, typically of the Saligna variety, and thin gauge sheet steel.

Despite the modest cost, it is anticipated that the headboard will be able to withstand the imposed loading comfortably. In initial testwork in an hydraulic press, a headboard of the illustrated type was able to withstand a compressive load of 70t without failing.

We claim:

1. A mine prop headboard which is adapted for location transversely on an end of an elongate mine prop which is in use installed upright between a hanging wall and a footwall in a mine working, the headboard comprising:

a chock assembly which includes parallel, elongate timber chocks in interconnected relationship, and a sheet of reinforcing material which is secured to and extends over and substantially covers the chock assembly to define a flat, planar, continuous support surface which is of a size to support an inflatable grout bag, and furthermore to provide tensile reinforcement for the chock assembly when a grout bag is in use positioned on the support surface and is inflated with grout under pressure so that the inflated grout bag applies a compressive axial force to the prop between the hanging wall and the footwall.

2. A mine prop headboard according to claim 1 wherein the sheet of reinforcing material means comprises a sheet steel member fastened intimately to and extending over the support surface of the chock assembly.

3. A mine prop headboard according to claim 2 wherein opposite ends of the sheet steel member are bent over to form bag-locating flaps which in use are locatable over opposite extremities of the grout bag thereby to locate the bag relative to the chock assembly.

4. A mine prop headboard according to claim 3 wherein the sheet steel member is nailed to the chocks.

5. A mine prop headboard according to claim 3 wherein the chocks are spaced apart by at least one endgrain timber block in which the timber grain is operatively vertical.

6. A mine prop headboard according to claim 5 comprising a pair of chocks spaced apart by at least one block, the chocks and the at least one block, in combination, forming an H-shape in plan view.

7. A mine prop headboard according to claim 6 and comprising a centralising formation which operates in use to centralise the combination of the chocks and the at least one block on the end of the elongate prop.

8. A mine prop headboard according to claim 7 wherein the centralising formation comprises a hole in the underside of the headboard, the hole being adapted to receive a peg protruding from the end of the prop.

9. A mine prop headboard according to claim 8 and comprising a sheet steel anchoring member which extends across the at least one block and is secured to the chocks on opposite sides of the at least one block.

10. A mine prop headboard according to claim 9 wherein the sheet steel anchoring member has generally a top-hat or channel cross-section.

11. A mine prop headboard according to claim 5, the headboard having an opening which is located in a position to grant access to a filler nozzle for the grout bag.

12. The combination of a mine prop headboard according to claim 2 and an elongate mine prop, the headboard spanning transversely across the upper end of the mine prop.

13. The combination of a mine prop headboard according to claim 5 and an elongate mine prop, the headboard spanning transversely across the upper end of the mine prop with the upper end of the mine prop bearing partially against the at least one block and partially against the chocks.

14. A mine prop support system comprising a combination according to claim 12 and an inflatable grout bag located on and supported by the headboard.

15. A mine prop support system comprising a combination according to claim 13 and an inflatable grout bag located on and supported by the headboard.

* * * * *